US005197734A

United States Patent [19]

Ashihara

[11] Patent Number: 5,197,734

[45] Date of Patent: * Mar. 30, 1993

[54] CROSSHANDED GUARD BATON (A)

[76] Inventor: Hideyuki Ashihara, 360-1, 8-chome, Sanbancho, Matsuyama-shi, Ehime-ken, Japan

[ * ] Notice: The portion of the term of this patent subsequent to Mar. 9, 2010 has been disclaimed.

[21] Appl. No.: 821,883

[22] Filed: Jan. 17, 1992

Related U.S. Application Data

[63] Continuation of Ser. No. 601,617, Oct. 24, 1990, abandoned, which is a continuation of Ser. No. 593,716, Oct. 4, 1990, abandoned, which is a continuation of Ser. No. 394,031, Aug. 15, 1989, abandoned.

[30] Foreign Application Priority Data

Jan. 20, 1989 [JP] Japan ..... 1-12994

[51] Int. Cl.[5] ..... F41B 15/02

[52] U.S. Cl. ..... 273/84 R

[58] Field of Search ..... 273/84 R, 84 ES, 67 R, 273/81 A, 81 C, 81.2, 80 D; 74/551.9; 362/102

[56] References Cited

U.S. PATENT DOCUMENTS

| | | | |
|---|---|---|---|
| 1,842,922 | 1/1932 | Frantzius . | |
| 2,391,782 | 12/1945 | Hutchison | 273/84 |
| 3,635,374 | 1/1972 | Anketell | 273/84 R |
| 3,716,170 | 2/1973 | Mangels | 222/162 |
| 3,716,710 | 2/1973 | Mangels | 222/162 |
| 4,109,912 | 8/1978 | Zentmyer | 273/84 |
| 4,132,409 | 1/1979 | Taylor | 273/84 |
| 4,203,599 | 5/1980 | Starrett | 273/84 |
| 4,479,171 | 10/1984 | Mains | 362/102 |
| 4,694,981 | 9/2987 | Miller, Jr. | 224/251 |
| 4,739,990 | 4/1988 | Aguirre et al. | 273/84 |
| 4,964,636 | 10/1990 | Ashihara . | |

FOREIGN PATENT DOCUMENTS

| | | | |
|---|---|---|---|
| 831626 | 6/1938 | France . | |
| 1287775 | 2/1962 | France . | |
| 2491719 | 10/1980 | France . | |
| 1187979 | 4/1970 | United Kingdom | 273/84 R |

*Primary Examiner*—V. Millin
*Assistant Examiner*—William M. Pierce
*Attorney, Agent, or Firm*—Nikaido, Marmelstein, Murray & Oram

[57] ABSTRACT

A crosshanded guard baton which comprises a longitudinal club and a crosshandle which is branched thereon at a place toward a club end with a branching length comparable to a breadthal length of a man's hand palm and is comprised of two or three portional grip members which are laid on slidably one another to form a stand on a mounting base on the club. This type of crosshandle is reinforced in this invention with equipment of a lightening device and/or a gas ejecting device, which are accommodated in the club interior or in the handle. Thereby, a baton carrier is convenienced in an encounter with a furious assailant in a gloomy area.

11 Claims, 4 Drawing Sheets

CROSSHANDED GUARD BATON (A)

This application is a continuation of application Ser. No. 601,617 filed Oct. 24, 1990, now abandoned, which is a continuation of application Ser. No. 593,716 filed Oct. 4, 1990, now abandoned which is a continuation of application Ser. No. 394,031, filed Aug. 15, 1989, now abandoned.

FIELD OF THE INVENTION

This invention relates to a guard baton or police billy or the like. Particularly, this relates to a crosshandled guard baton.

DESCRIPTION OF THE CONVENTIONAL ART

The term "crosshandled guard baton" is intended to indicate a guard baton which has a short handle branchedly secured on a main club body at a biased place or location between an end and a central portion of the club length. A guard baton of this type is described in U.S. Pat. No. 4,132,409 which has been only the sole conventional art according to the inventor's knowledge.

In this U.S. patent, the handle is axially divided into two portions, stationary and rotatable, and the description therein teaches that the stationary one is put into motion when rotating or swinging of the club is intended. However, it is not determinable whether the crosshandle is gripped by the right hand or the left hand of a baton user, and a change of gripping this handle from the right hand to the left or vice versa is also probable. Thus, a device for braking the rotating club should be improved to be more conventional to grip by either hand. This was the starting point of this invention. In addition, new devices are introduced to the present inventive baton and these devices will become apparent in the following description. On the other hand, KARATE, a kind of sports or practice for combat without a hand weapon, bas become popular in the world and such a combat practice is sometimes used by an assailant against the police or security personnel. Therefore, those who are entitled to wear such a guard property as a baton are desirous that their guard property be improved, in particular, be improved so as to provide KARATE actions on an enlarged scale and to which purpose a rotatable crosshandled baton is basically appropriate. An improvement in the braking device with a guard baton is also particularly suited, because in KARATE techniques wielding of two hands is important, but at the same time, a quick stop of a hand action is necessary to make use of a foot to kick or to add an attack by footwork.

In connection with the crosshandled guard batons, two U.S. patent applications have been filed by the present inventor with the following identifications: Ser. Nos. 312,988 and 313,003, both filed on Feb. 21, 1989, In contrast to these previous inventions, this invention makes improvement relative to a gas ejecting device as well as a lighting or illuminating device as will be apparent later.

SUMMARY OF THE INVENTION

This invention is generally summarized as featuring a crosshandled guard baton which comprises a club having a longitudinal axis and a crosshandle transversely branched on the club at a biased place toward a club end, wherein the crosshandle (the term "crosshandle" will often be abbreviated to "handle" in the following) has a branching length comparable to a breadthal length or width of a man's hand palm and is typically defined by three portional members of a lower grip, central grip and upper grip which are laid on one another to form a stand on a mounting base formed on the club, and internally of the handle, a longitudinal shaft, typically in the form of a tube, is secured on the mounting base and is extended to reach through an outer end of the upper grip. The shaft is rotatably supported with the lower and upper grips while the central grip is fastened to the shaft such that the club is turnable around the handle with a concurrent motion of the central grip, hence keeping the lower and upper grips independent of the motion with the club and central grip. Further, the handle may also be modified to dispense with the rotatable lower grip from the rest of the members defining the handle.

Further, the present invention is particularly directed to guard batons having additional equipment in the form of a lighting device and also a gas ejecting device as functional additions to a guard baton.

Conventionally, these two kinds of functional devices have not been incorporated in a police billy, and a person would be required to carry a pocket light, for instance, as another hand property, which situation has inevitably caused some inconvenience in taking actions, especially, in a gloomy area or in an encounter with a furious assailant.

Figure 1:
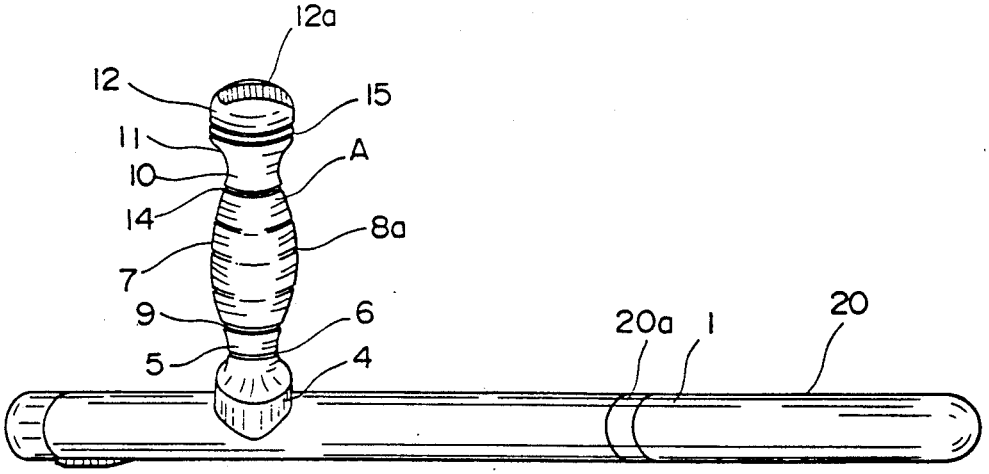
FIG. 1 shows a perspective view of an inventive embodiment.

These drawings are presented to illustrate the invention and therefore the drawings should not be construed as limiting the invention. In the drawings a like numeral indicates a like part, and a length of the club is sometimes shortened out of scale without a cut mark and such should not be construed to destroy the invention.

DESCRIPTIONS OF THE EMBODIMENTS

Figure 2:
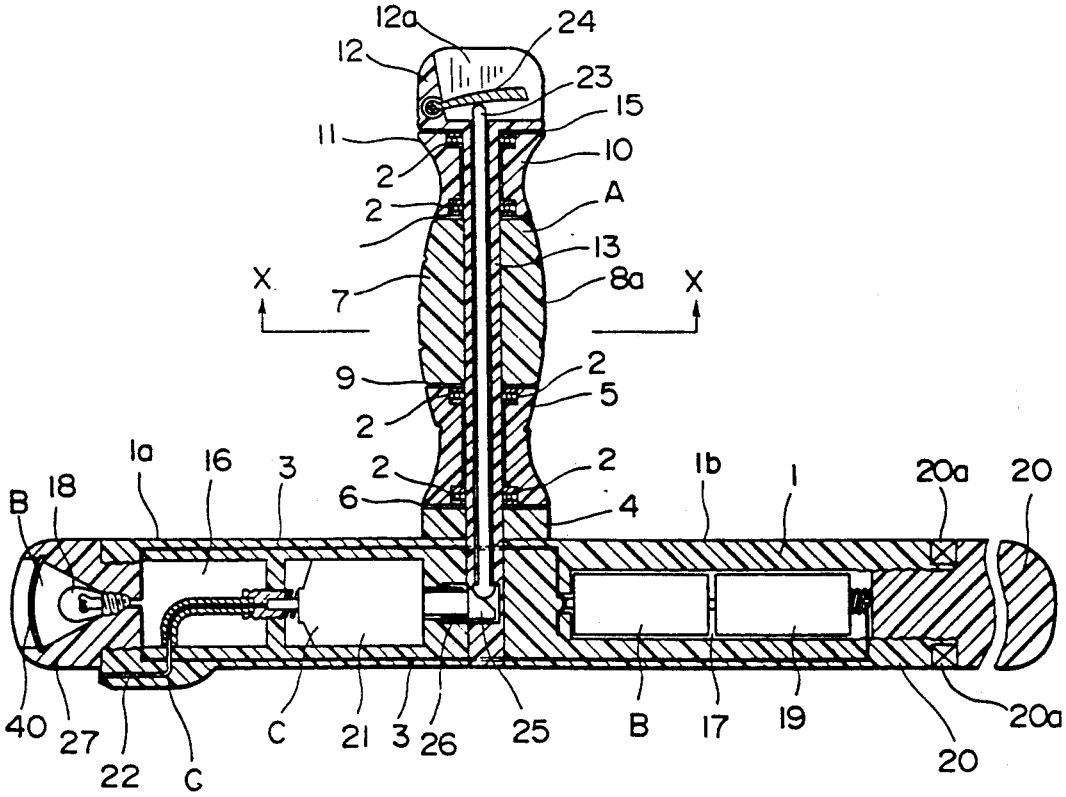
FIG. 2 shows a vertical view in section of the embodiment of FIG. 1.
Figure 3:
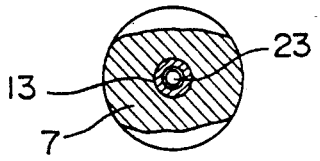
FIG. 3 shows a sectional view as seen along a line X—X indicated in FIG. 2.

With reference to FIGS. 1 to 3, 1 is a club which is made of a hard material, for instance, or wood, metal or plastic and, in the case of a plastic, it is recommended to reinforce it with tough aramid fibers, for instance, KEVLAR, by interlacing such fibers in plastic layers with orientation to a longitudinal axis of the club 1. Size of a club 1 is preferably about 60 cm in length and about 3 cm in diameter.

A handle A is transversely branched at a place toward an end of the club 1, wherein a mounting base or saddle base 4 is formed to offer a flat face at the place as mentioned, on which is first laid a lower grip member 5 which is shaped to be a round grip, wherein a contact plane of the lower grip 5 to the base 4 is formed to make a slide contact plane 6, of which function will appear later. Then, a central grip member 7 is laid on the grip member 5 to form a similar slide contact plane 9 inbetween and thereafter an upper grip member 10 is laid on the central one 7 likewise to form a slide contact plane 14 inbetween. Another upper grip or cap 12 is fitted over on top, of grip 70 but between members 10 and 12 still another slide plane 15 is made. These members after assembly as shown in the drawings will be applied to a gripping, size of which is therefore preferably about 11 cm long and diameter of the cap member 12 is about 3.5 cm, wherein the assembled grip members as a whole are, as shown in the drawings, preferably shaped to take an appearance like a bowling pin, convenient to a handgripping. In other words, round side faces of the lower grip 5 and upper grip 10 are squeezed to recurve such that an angular corner 11 is formed and a similar side of the central grip 7 is made like a barrel flank, and further an outside shape of the handle may be varied from a circle in section, for instance, to be elliptic in section for more convenience to the handgrip central grip 7 as shown by FIG. 3.

Making reference to internal structures, a tube or tubular shaft 13 is provided longitudinally of the handle A and has its footing end secured in the club 1, penetrating through the base 4, and the shaft 13 is extended upwardly to each a top end of the grip 10 to integrate or combine with the cap member 12 as shown in FIG. 2, wherein the shaft 13 is rotatably supported with ball bearings 2, 2, for the lower grip 5 and the same 2, 2, for the upper grip 10, while the shaft 13 is fastened with the central grip 7 as shown by 3. It shows the shaft 13 in square section, at the section X—X line in FIG. 2.

The structure as noted is annotated here to explain functions in the invention. That is, "rotatably supported" means that, when a rotatably supported grip is firmly held externally, the grip member held externally remains stationary while internally the shaft 13 is permitted to move or turn, and as will be apparent later, in use, the two upper and lower grip members are recommended to be held by the hand palm while the central grip is let free to turn with the club. When the turning club is intended to stop, a touch onto the central grip is used to effect the braking action. Therefore, several lateral grooves 8*a* are provided around the central grip 7 to enhance friction against the hand palm.

The cap 12 is mounted on the upper grip 10 and internally, for the whole length of the tube shaft 13, a trigger rod 23 is sheathed with up-down mobility, and its top end is kept to be a slightly headed above a bottom face of a recessed space 12*a* formed in the cap 12 and is in contact with a lever 24 which is pivoted on a side wall of the recess 12*a*.

Making reference to internal structure of the club 1, longitudinally thereof, two hollow spaces are formed internally of the club segment 1*a* having a shorter range from the base 4 and of the club segment 1*b* having a longer range from the base 4. These two spaces 16, 17 are utilized to accommodate one or two functional devices, an illuminating or a lighting device B and/or a gas ejecting device C.

FIG. 2 shows an embodiment wherein a lighting device B and a gas ejecting devices C are accommodated. Specifically, in the space 16, a gas bomb 21 is inset and an ejecting pipe 22 is led from a forward end of the bomb outwardly to an underside of the club 1 to an end opening 22 and at the bomb rearside, a ram having a beveled face 25 is mounted with urging action of a spring 26. A bottom end of the trigger rod 23 is contacted with the beveled face 25 such that an actuation of the lever 24 will effect a stroke to the ram 25 which will cause a gas ejection. In the space 17, battery units 19 are inset and connected by an electrical lead line 3 to a lamp 18 which is mounted in a plug tip 27 with a lens window 40 and an on-off actuation for lighting is effected by a push at a rearside of the battery unit 19. Specifically, outer portion of the club segment 1*b* is formed of a plug 20, which is screw-engaged with the rest of the segment 1*b*, and an elastic packing 20*a* is incorporated, by which compressibility the on-off act of the battery 19 is effected.

the following descriptions of new embodiments, explanations will concentrate on the new devices and functions which have not yet been described, with brief reference to related elements that have been previously described.

Figure 4:
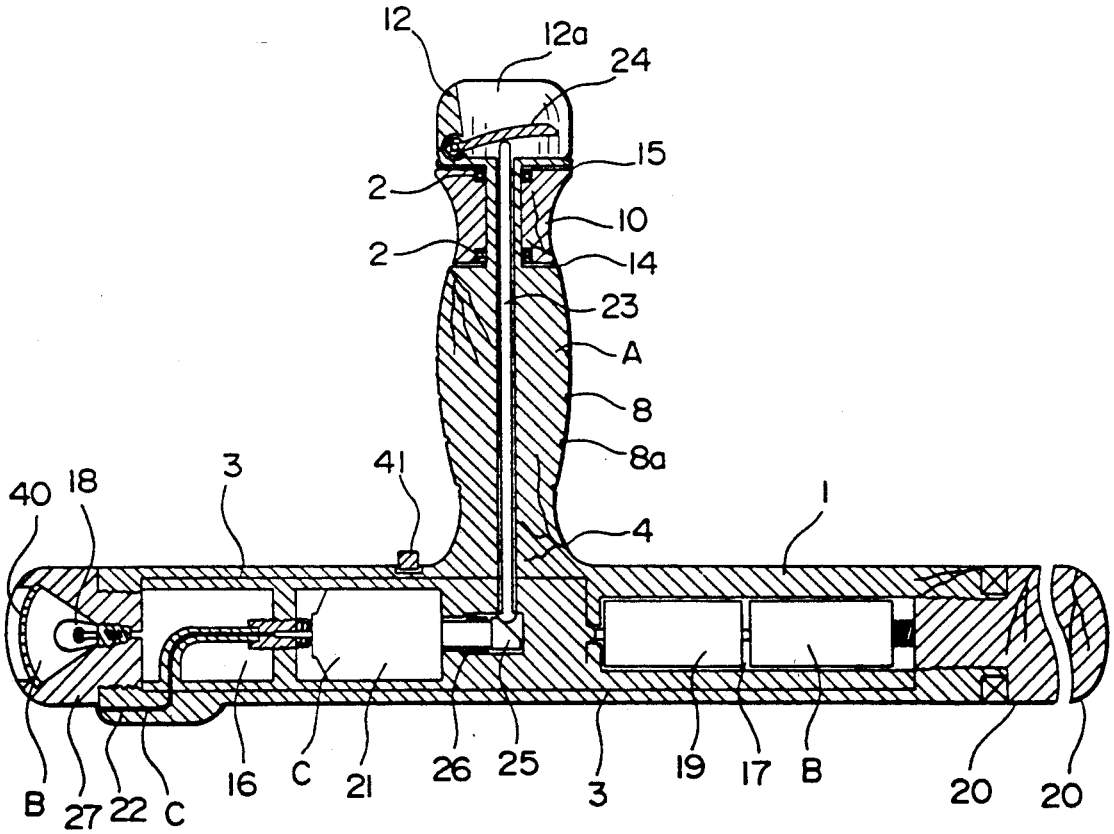
FIG. 4 shows a vertical view in section of another embodiment.

With reference to FIG. 4, this embodiment is simplified, firstly, in construction of the handle A, by eliminating removing a lower grip member so as to define the handle A with two members of a main grip 8 and an upper grip 10, wherein the main grip 8 is integrated with a base 4 so as to move with the club 1, and the upper grip 10 is maintained to be rotatable. Further, secondly the on-off actuation for lighting is designed to be effected by a switch 41 which is provided on the club 1 close to the base 4.

Figure 5:
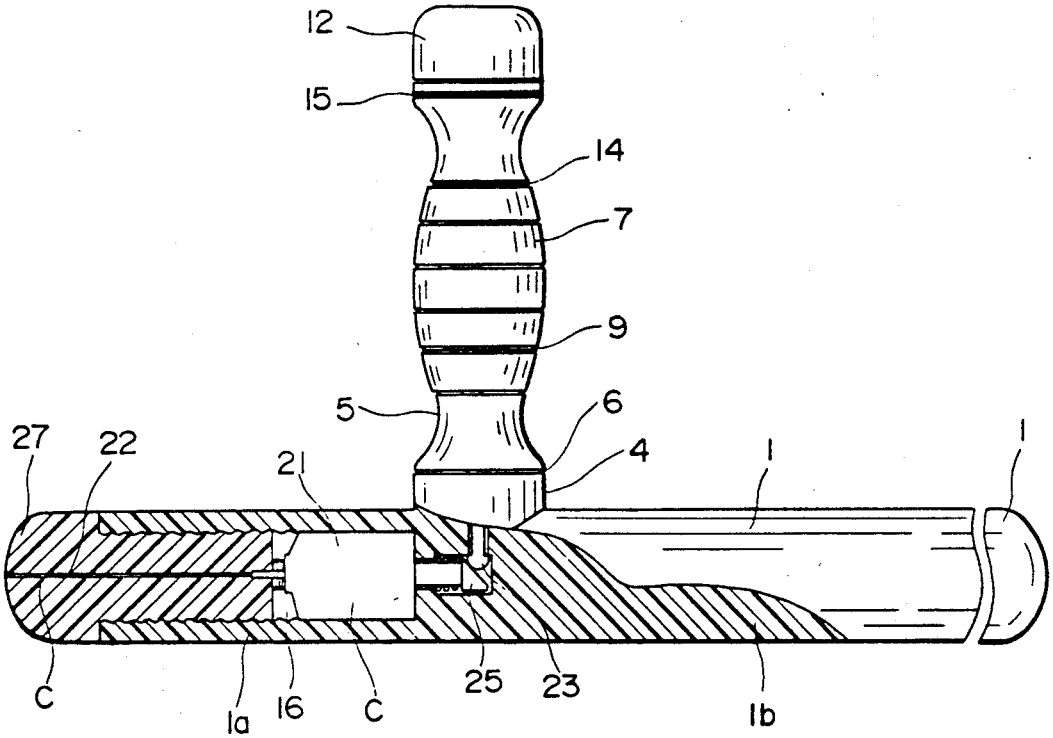
FIG. 5 shows a vertical view, partly in section, of an embodiment featuring in equipment of a gas ejecting device in a club.

With reference to FIG. 5, in this embodiment, a hollow space is only formed inside the club segment 1*a* wherein a gas ejecting device is accommodated. A gas ejecting pipe 22 extends through a plug 27 and opens at the end of the plug 27.

Figure 6:
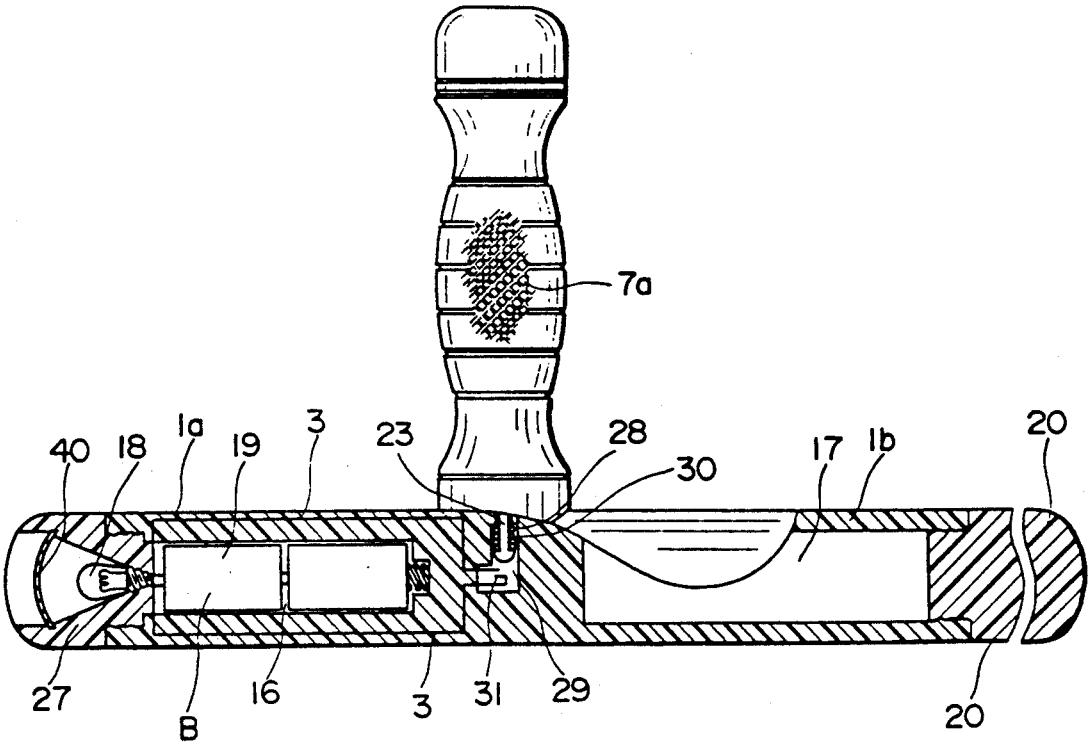
FIG. 6 shows a vertical view, partly in section or enlarged to advantage, of still another embodiment featuring a lighting in a club.

With reference to FIG. 6, two spaces 16, 17 are formed, in the club but one space 16 is utilized to provide a lighting device B wherein, although the trigger rod 23 is apparent in minor portion, an on-off actuation for the lighting device is designed to be performed by contact of a bottom end 29 of the rod 23 onto a contact element 31 connected in an electrical lead line 3. A lower portion of the rod 23 is provided with a slenderized or reduced diameter step 28 which is wound around by a spring 30 which will bias or recoil the rod 23 back upwardly. 7*a* is a crossmesh pattern which is formed on the central grip 7 to avoid slippage against the hand.

Figure 7:
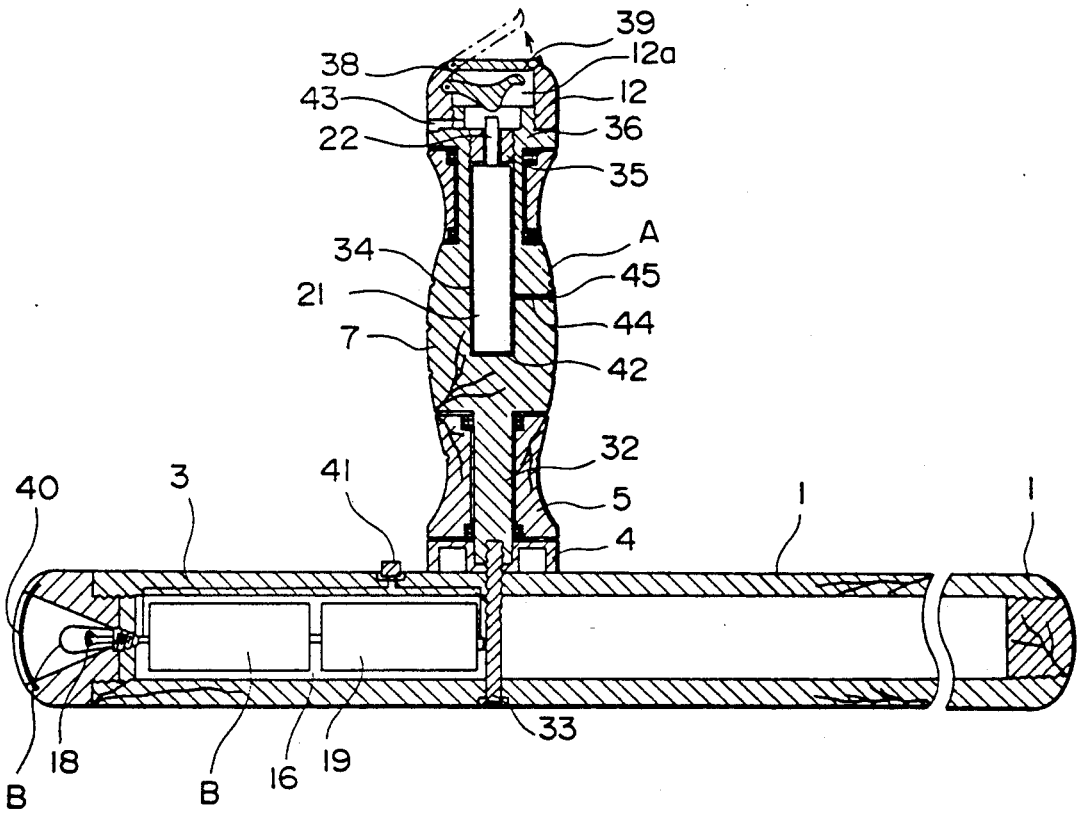
FIG. 7 shows a vertical view in section of a still further embodiment of the invention.

With reference to FIG. 7, a lighting device B is accommodated in a space 16 and a gas ejecting device C is inset in a handle A and a tube or tubular shaft and a sheathed rod as used in prior embodiments are eliminated. In this embodiment, a stud pin 33 is driven access the club 1 into a backbone portion 32 of the handle A to secure the handle A as a whole to the club 1, which permits concurrent motions of the club 1 with the central grip 7 as described before.

A gas bomb 21 is inset vertical in a hollow interior space 34 formed in an upper portion of the handle A and the inset bomb 21 is sealed with a plug 35 by screw engagement wherein a gas ejection pipe 22 is extended from the bomb 21 upward through the plug 35. A top end of the pipe 22 is positioned closely below a lever 38 which will actuate gas ejection by pressing the pipe end. Then, a gas is let off across, like in the case of a can-spray, toward outside via a hole 43 which is provided in a side wall of a recess 12*a*. In order to protect the lever 38, a pivotal lid 39 is mounted on the cap 12. A device 42 is provided to resist a play or movement of the bomb 21 inset in the handle and 44 is a passage for externally refilling the gas bomb from an opening 45.

Figure 8:
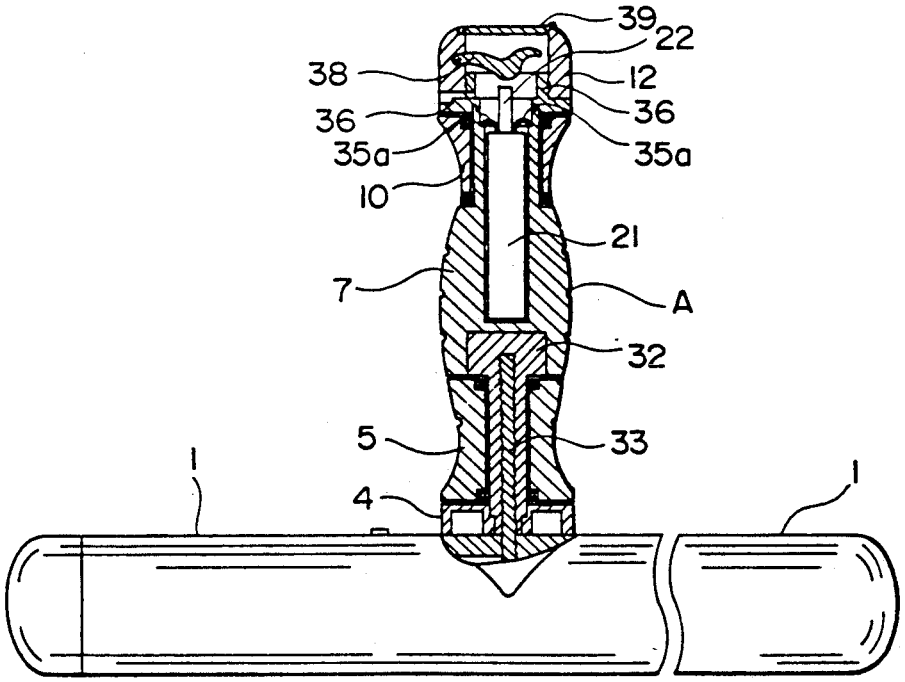
FIG. 8 shows a vertical view, partly in section, of a still further embodiment of the invention.

With reference to FIG. 8, assembly of a handle A is modified such that a backbone member 32 is preliminarily assembled with a stud pin 33 and a lower grip 5 and then this assembled block is secured on a base 4 with fastening of the stud 33 into a club 1 by screw engagement.

With reference to the gas bomb 21, as attachment member 36 is fitted on an upper end of the member 7 and also on a cap 12, and the member 36 is designed to engage with a clamp piece 35*a* which will resist a play or movement of the bomb 21.

What is claimed is:

1. A crosshandled guard baton which comprises:

a club having a longitudinal axis and at least one hollow internal space;

a crosshandle transversely branched on the club at a place located toward one end of said club, said crosshandle having a branching length substantially equal to the width of a man's palm;

said crosshandle comprising three portional members including a lower grip, a central grip, and an upper grip which are stacked on one another with rotary interslidability therebetween;

a tubular shaft provided internally of said crosshandle and extending through a longitudinal length of said crosshandle, said tubular shaft being secured at one end to said club and secured to said central grip and rotatably mounted internally of said upper grip and said lower grip;

a rod provided internally of said tubular shaft and axially movable relative to said tubular shaft;

an illuminating device or a gas ejecting device accommodated in said hollow internal space of said club; and a trigger means for operating at least one of said illuminating device or gas ejecting device by axial movement of said rod actuated by a lever provided on top of said crosshandle and engaging said rod.

2. A crosshandled guard baton which comprises:

a club having a longitudinal axis and at least one hollow internal space;

a crosshandle transversely branched on the club at a place located toward one end of said club, said crosshandle having a branching length substantially equal to the width of a man's palm;

said crosshandle comprising two portional member including a main grip and an upper grip laid on top of the main grip with rotary interslidability therebetween;

a tubular shaft provided internally of said crosshandle and extending through a longitudinal length of said crosshandle, said tubular shaft being secured to said club and said main grip and rotatably mounted internally of said upper grip;

a rod provided internally of said tubular shaft and axially movable relative to said tubular shaft;

an illuminating device or a gas ejecting device accommodated in said hollow internal space of said club; and a trigger means for operating at least one of said illuminating device or said gas ejecting device by axial movement of said rod actuated by a lever provided on top of said crosshandle and engaging said rod.

3. A crosshandled guard baton as defined by claim 1 or 2, wherein a gas ejecting device including a gas bomb is provided in said hollow internal space of said club, a ram having one end formed as a beveled face is provided for actuating said gas ejecting device and said beveled face is disposed in contact with one end of said rod for movement in response to axial movement of said rod.

4. A crosshandled guard baton as defined by claim 1 or 2, wherein an illuminating device is provided in said club and said illuminating device includes a lamp provided at one end of the club and said lamp is connected by lead wires to lamp actuating means.

5. A crosshandled guard baton as defined by claim 1 or 2, wherein the rod includes a reduced diameter portion and further including a spring wound around said reduced diameter portion of said rod and biasing said rod against actuating movement by said lever.

6. A crosshandled guard baton as defined by claim 1 or 2, wherein a hollow interior space is open at one end of said club and a plug is fitted in said open end of the club.

7. A crosshandled guard baton as defined by claim 1 or 2 and further including a hollow space provided internally of said crosshandle and a recessed space provided on the top of said crosshandle;

a gas pressurized canister in said hollow internal space of said crosshandle, a gas ejecting pipe leading from said gas canister to said recessed space on the top of said crosshandle, and a lever means provided in said recessed space adjacent one end of said gas ejecting pipe and movable to contact and move said gas ejecting pipe and thereby actuate a gas ejection from said gas canister.

8. A crosshandled guard baton as defined by claim 7, wherein an opening is formed through a sidewall of said recessed space and a hole is provided in said gas ejecting pipe to eject gas toward said opening formed in the sidewall of said recessed space.

9. A crosshandled guard baton as defined by claim 7, and further including a gas refill hole formed on an external surface of the crosshandle and a passage communicating said gas refill hole with said gas bomb for supplying gas to said bomb.

10. A crosshandled guard baton as defined by claim 7, and further including a lid to enclose said recessed space.

11. A crosshandled guard baton as defined by claim 7, wherein said club includes an illuminating device in said hollow internal space of the club.

* * * * *